United States Patent [19]

Yamada

[11] 4,186,158

[45] Jan. 29, 1980

[54] CARBURETOR WITH MODIFIED VENTURI FOR ITS PRINCIPAL NOZZLE

[75] Inventor: Minoru Yamada, Iwata, Japan

[73] Assignee: Yamaha Hatsudoki Kabushiki Kaisha, Iwata, Japan

[21] Appl. No.: 881,789

[22] Filed: Feb. 27, 1978

[30] Foreign Application Priority Data

Apr. 14, 1977 [JP] Japan ..... 52-45735

[51] Int. Cl.[2] ..... F02M 19/08

[52] U.S. Cl. ..... 261/23 A; 261/78 R; 261/DIG. 39; 123/141

[58] Field of Search ..... 261/DIG. 39, 78 R, 76, 261/23 A; 123/141

[56] References Cited

U.S. PATENT DOCUMENTS

| | | | |
|---|---|---|---|
| 1,519,773 | 12/1924 | Dyer | 261/76 |
| 1,562,126 | 11/1925 | Saives | 261/76 |
| 2,102,113 | 12/1937 | Djordjevitch | 261/DIG. 39 |
| 2,609,280 | 9/1952 | Cremean | 123/141 |
| 2,991,052 | 7/1961 | Carlson et al. | 261/DIG. 39 |
| 3,168,599 | 2/1965 | Marsee et al. | 261/DIG. 39 |
| 3,326,539 | 6/1967 | Phipps | 261/DIG. 39 |
| 4,019,483 | 4/1977 | Konomi et al. | 123/141 |

FOREIGN PATENT DOCUMENTS

| | | | |
|---|---|---|---|
| 1017247 | 12/1952 | France | 261/78 R |
| 515147 | 2/1955 | Italy | 261/76 |
| 881461 | 11/1961 | United Kingdom | 261/78 R |

*Primary Examiner*—Tim R. Miles

*Attorney, Agent, or Firm*—Donald D. Mon

[57] ABSTRACT

A carburetor which supplies a plurality of cylinders, with a modified venturi for its principal nozzle. The outlet end of the principal nozzle is specially shaped and inclined whereby more uniformly to inject fuel across the entire cross-section of the inlet to the inlet manifold.

5 Claims, 4 Drawing Figures

CARBURETOR WITH MODIFIED VENTURI FOR ITS PRINCIPAL NOZZLE

This invention relates to a multi-venturi type carburetor for supplying a plurality of cylinders of an internal combustion engine with a mixture through an intake manifold.

In general, for obtaining a good combustion in all cylinders of a multi-cylinder internal combustion engine, it is required that the air/fuel ratios of mixture supplied to respective cylinders be equal.

However, when air/fuel mixture is fed into a plurality of cylinders of, for example, a four cylinder engine, from a multiventuri type carburetor having a small venturi, the ratio of the mixture supplied to each cylinder is not always equal.

This difference in the ratio (or richness) is attributable to the positional relationship between the cylinders and the main nozzle of the carburetors, and the firing order of the cylinders.

As a matter of fact, the ratio of the mixture supplied to the cylinders disposed at the side of a wall in which the main nozzle of the small venturi opens is richer than the ratio which is supplied to the other cylinders. This is because the fuel is supplied from the main nozzle in the form of drops which are concentrated to the side of the main nozzle, thereby locally to enrich the mixture.

Under these circumstances, an object of the present invention is to provide a carburetor of the described type, in which the opening side of the main nozzle at the downstream side end of the small venturi is shaped and inclined so as to equalize the air/fuel ratio of the mixture as supplied to all of the cylinders.

A preferred embodiment of the invention will be described hereinafter with specific reference to the drawings, in which.

Figure 1:
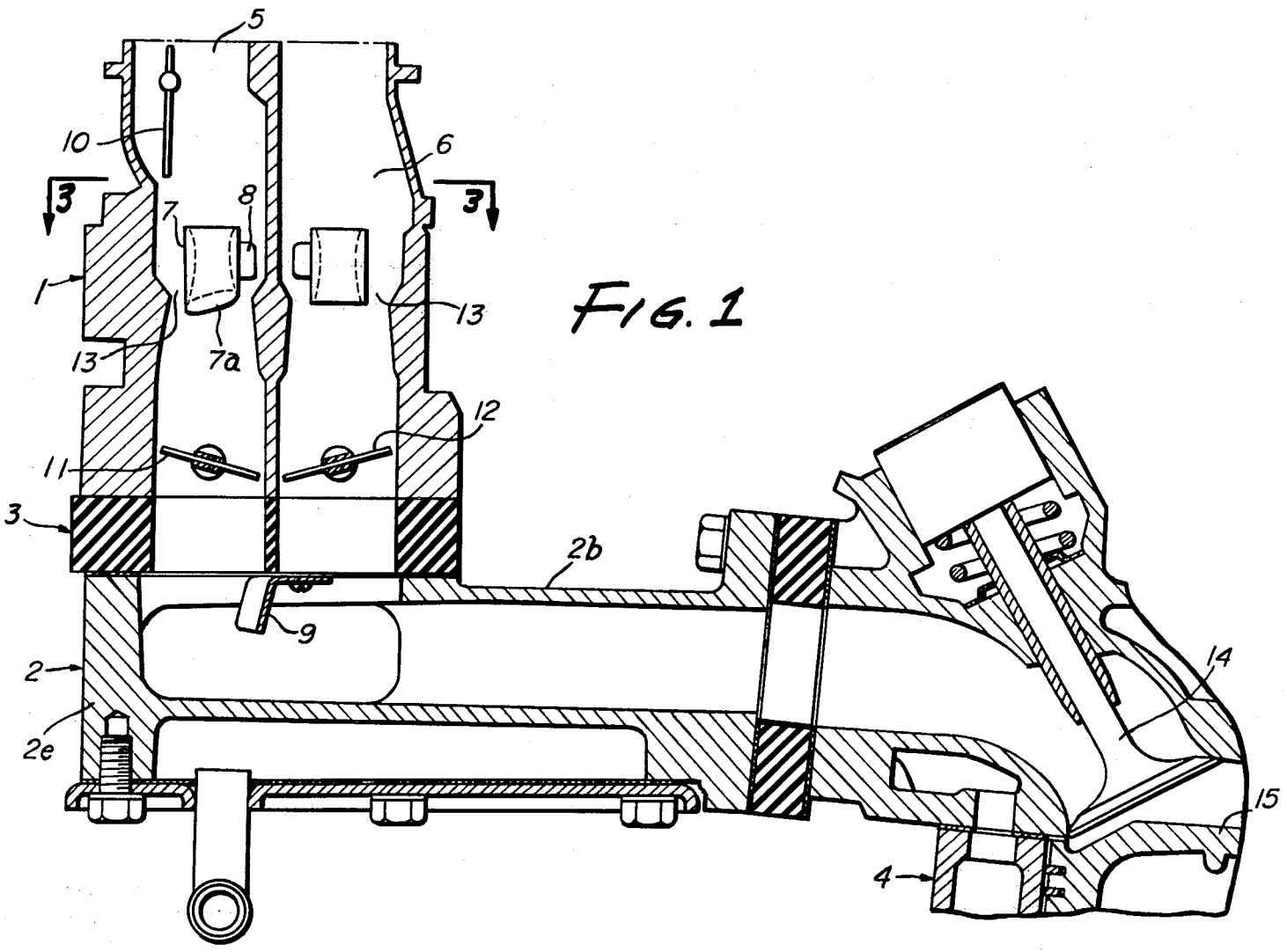
FIG. 1 is an axial view of the presently preferred embodiment of the invention.

Referring at first to FIG. 1, a compound carburetor 1 of the down draft type is connected to an intake manifold 2 through a heat insulating member 3. The intake manifold 2 is bent horizontally, just below the carburetor 1. Numeral 4 denotes four cylinders of an internal combustion engine arranged in tandem fashion. The carburetor 1 and the heat insulating member 3 have a primary intake passage 5 and a secondary intake passage 6. The primary intake passage 5 accommodates a choke valve 10 and primary throttle valve 11, while the secondary intake passage 6 accommodates a secondary throttle valve 12. The secondary passage is disposed closer to the engine 4 than the primary passage. Intake manifold 2 is connected to the downstream side of the intake passages 5, 6. It has a manifold floor **2*e* which has at one side branch pipes 2*a*, 2*b* and at the other side branch pipes 2*c*, 2*d* connected to respective cylinders 4** of the engine.

Figure 3:
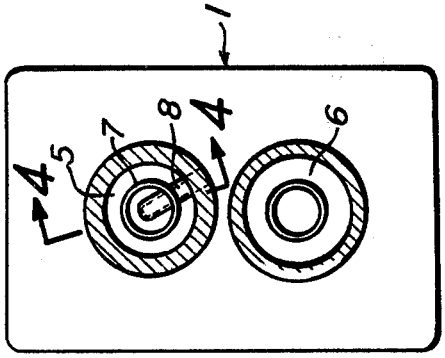
FIG. 3 is a cross-section taken at line 3—3 in FIG. 1.
Figure 4:
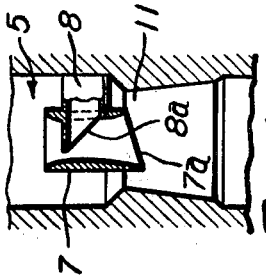
FIG. 4 is a cross-section taken at line 4—4 in FIG. 3.
Figure 2:
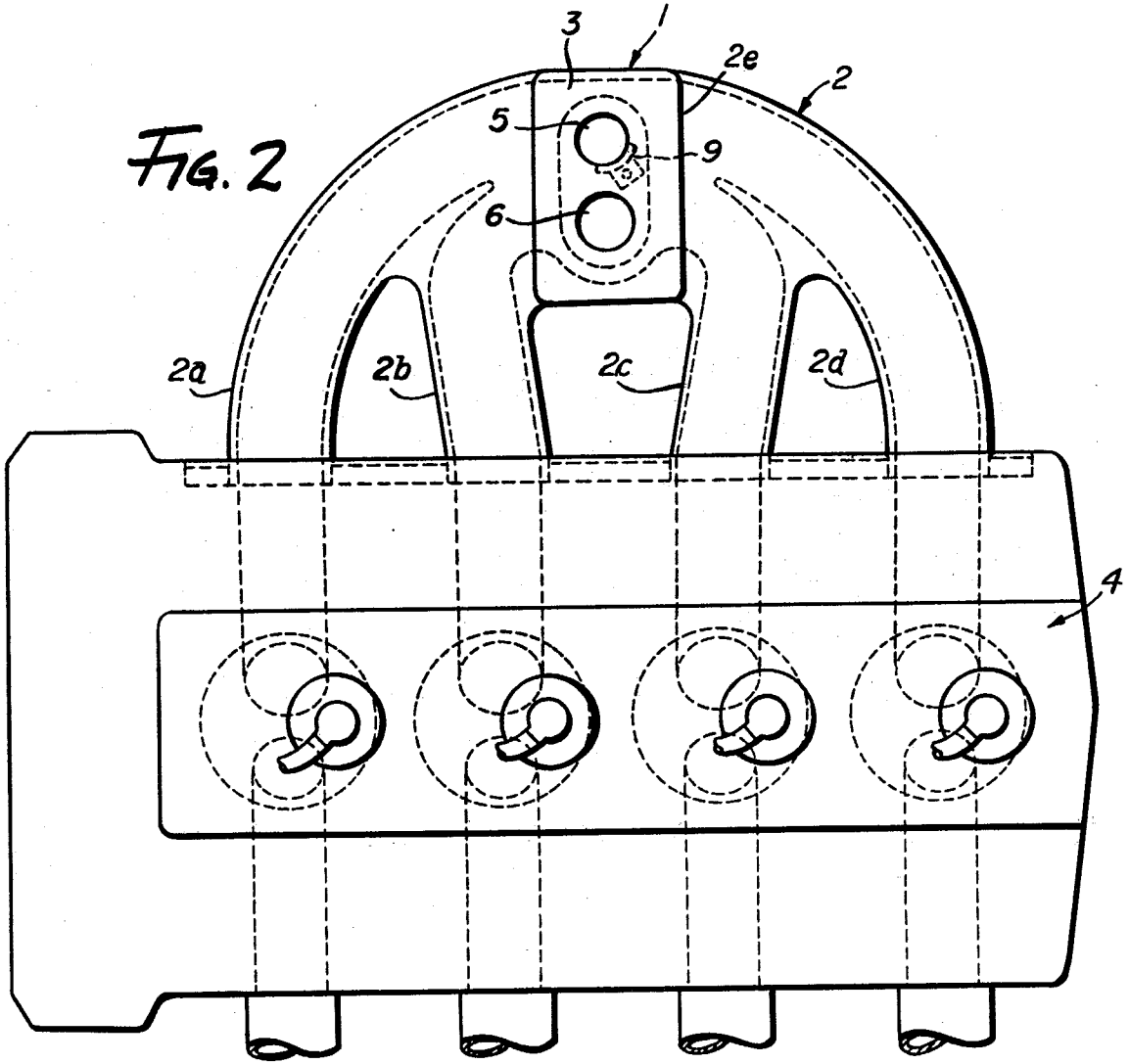
FIG. 2 is a plan view of a typical intake manifold, with some features of the invention superimposed on it.

As will be seen from FIGS. 1, 3 and 4, a main nozzle 8 leading to a float chamber (not shown) opens into a small venturi 7 which is disposed in the primary intake passage 5. It opens outwardly at an angle of about 45° to the direction in which the cylinders 4 of the engine are arrayed. The downstream end of the small venturi 7 is a continuous ellipse inclined at an angle to the axis of the small venturi and to the axis of the nozzle. Thus it may be said to be "recessed" as viewed along the axis of the primary intake passage, having its uppermost elevation adjacent to the main nozzle itself where the mixture is apt to be richer. The opening end **8*a* of the main nozzle 8 into the small venturi 7 is inclined with respect to the axis line of the nozzle 8**, in such a manner that the amount of extension into the small venturi is smallest at the downstream side end thereof.

A plate 9 for settling the flow is extended confronting the branch pipes **2*c* and 2*d*, from the periphery of the downstream side end of the primary passage 5 into the intake manifold 2, so as to prevent the mixture for the branch pipes 2*c*, 2*d* at one side of the floor 2*e* from becoming richer than that for the branches 2*a*, 2*b*** at the other side.

In the drawings, numerals 13, 14 and 15 denote, respectively, a large venturi, an intake valve and a piston.

Generally speaking, in multi-venturi type carburetors, fuel is fed from the main nozzle into the small venturi in an atomized form, so as to create the air/fuel mixture. Since the downstream side end of a conventional small venturi is arranged at a right angle to the axis line thereof, the fuel supplied from the main nozzle is apt to be concentrated toward the opening side of the main nozzle and enrich the mixture there, especially in the light and medium load operation of the engine in which the intake flow is relatively small.

In good contrast to the above, in the carburetor of the described embodiment, the small venturi 7 is inclined as described, so that the intake flow through the small venturi is deflected in the opposite direction to the opening of the main nozzle 8. This is attributable to the fact that the amount of air passing along the periphery of the venturi 7 increases at the side closer to the main nozzle opening 8 than at the opposite side, so that the intake flow is as a whole deflected away the side closer to the main nozzle 8 toward the other side.

Thanks to this tendency of deflection of the intake flow, the conventional local concentration of the fuel to the side of the opening of the main nozzle 8 is compensated for, so that the mixture ejected from the small venturi 7 is uniformly spread within (across) the primary passage 5. Thus, the flow of the mixture exhibits a constant air/fuel ratio over the entire cross-section of the primary intake passage 5. Consequently, the richness of the mixture as supplied to respective cylinders 4 is equalized.

The invention is equally applicable to a carburetor in which the primary passage 5 is disposed at the end closer to the cylinders 4, promising an effect equivalent to that of the aforementioned embodiment.

An equivalent effect can be expected, when the small venturi is notched (recessed) at its downstream side closer to the main nozzle opening also in the secondary side of the carburetor.

The undesirable unequal enrichment of the mixtures to the specific cylinders due to reasons other than the location of the opening of main nozzle, e.g. the firing orders of the cylinders, can be fairly avoided by forming a notch in the downstream side end of the small venturi 7 to compensate for the local enrichment of the mixture, thereby to equalize the richness of the mixtures to all cylinders. The shape of the notch, as well as the location of the notch on the periphery of the small venturi is preferably determined by taking above stated compensation into account.

It will be clear from the foregoing description that the carburetor of the invention ensures a good combustion of the engine and, accordingly, a smooth operation of the engine with decreased noxious emissions, by equalizing the air/fuel ratio of the mixture to all of the cylinders, thanks to the provision of an inclined edge at the downstream side end of the small venturi.

This invention is not to be limited by the embodiments shown in the drawings and described in the description which are given by way of example and not of limitation, but only in accordance with the scope of the appended claims.

I claim:

1. In a multiple-barrel carburetor having a primary intake passage with an axis and a peripheral sidewall, a secondary intake passage, an intake manifold for receiving fuel-air mixture from said intake passages and distributing said mixture to a plurality of engine cylinders, a primary throttle valve in said primary intake passage, a secondary throttle in said secondary intake passage, both of said throttle valves being upstream from said intake manifold, a tubular venturi member upstream from said primary throttle valve in said primary intake passage and having an outer wall spaced from the sidewall of the primary intake passage, an upstream edge, a downstream edge, and a venturi passage extending between said upstream and downstream edges axially aligned with said axis of the primary intake passage, and a main nozzle passing through said wall of the venturi member and discharging into said venturi passage, said main nozzle having an opening end located in said venturi passage, the improvement comprising: said downstream edge lying in a plane inclined relative to the axis of said primary intake passage, and having its farthest-upstream point adjacent to said main nozzle.

2. Apparatus according to claim 1 in which said opening end of said main nozzle lies in a plane inclined at an angle to the axis of said primary intake passage, its farthest-inward point in said venturi passage being at the top of said opening end.

3. Apparatus according to claim 2 in which the said points of the downstream edge and opening end are axially aligned.

4. Apparatus according to claim 3 in which a deflector plate partially occludes the primary intake passage at its entry to the intake manifold in axial alignment with the main nozzle.

5. Apparatus according to claim 3 in which the main nozzle enters the primary intake passage at an acute angle relative to the alignment of a bank of said cylinders.

* * * * *